US006988728B2

(12) United States Patent
Kida

(10) Patent No.: US 6,988,728 B2
(45) Date of Patent: Jan. 24, 2006

(54) SHEET SORTER AND AN IMAGE FORMING APPARATUS

(75) Inventor: Yasuhiko Kida, Kashiwara (JP)

(73) Assignee: Kyocera Mita Corporation, Osaka (JP)

( * ) Notice: Subject to any disclaimer, the term of this patent is extended or adjusted under 35 U.S.C. 154(b) by 70 days.

(21) Appl. No.: 10/414,799

(22) Filed: Apr. 16, 2003

(65) Prior Publication Data

US 2004/0207153 A1 Oct. 21, 2004

(51) Int. Cl.
*B65H 39/10* (2006.01)
*B07C 5/00* (2006.01)

(52) U.S. Cl. ..... 271/292; 271/294; 271/298

(58) Field of Classification Search ..... 271/279, 271/287–290, 292, 294, 298; 270/52.03
See application file for complete search history.

(56) References Cited

U.S. PATENT DOCUMENTS 4,501,419 A * 2/1985 Takahashi et al. ..... 271/288
5,013,027 A * 5/1991 Furukawa ..... 271/290
5,161,795 A * 11/1992 Kim et al. ..... 271/288
5,328,169 A * 7/1994 Mandel ..... 271/290
5,704,609 A * 1/1998 Mandel et al. ..... 271/290
5,898,592 A * 4/1999 Salgado et al. ..... 700/214
6,146,085 A * 11/2000 Namba et al. ..... 414/789.9
6,227,539 B1 * 5/2001 Ferrara ..... 271/293
6,250,631 B1 * 6/2001 Hanamoto et al. ..... 271/298
6,546,313 B2 * 4/2003 Nakahira et al. ..... 700/224

* cited by examiner

*Primary Examiner*—Donald P. Walsh
*Assistant Examiner*—Joseph C. Rodriguez
(74) *Attorney, Agent, or Firm*—Jordan and Hamburg LLP

(57) ABSTRACT

A sheet sorter including a plurality of trays on which sheets are to be placed, adapted to sort sheets by switching the trays on which the sheets are to be placed, and designed to enable users to easily find their own sheets even if no tray is designated. Trays are each provided with a sensor for detecting the presence or absence of sheets, and the tray bearing no sheet is preferentially selected as the tray on which a sheet is to be placed when no tray is designated. If there are a plurality of trays bearing no sheet, the uppermost one thereof is selected. If there is no tray bearing no sheet, the tray having a longest duration from the last time when the sheet is placed thereon is selected.

14 Claims, 6 Drawing Sheets

FIG. 4

YOU CAN COPY

TRAY SELECTION

| | | |
|---|---|---|
| MAIN TRAY | TRAY 3 | AUTO |
| TRAY 1 | TRAY 4 | |
| TRAY 2 | TRAY 5 | |

52

FIG. 5

OUTPUT INFORMATION

JOB NO.: 5 OUTPUT TIME: 10:30 ON MAY 25

USER NAME: USER A SOURCE OF INPUT: COPY

JOB NAME: NONE

SHEET SIZE: A4 NUMBER OF SHEETS: 10

SET: 1 SORTING: NONE

TRAY DESIGNATION: NONE SELECTED TRAY: TRAY 2

52

SHEET SORTER AND AN IMAGE FORMING APPARATUS

BACKGROUND OF THE INVENTION

This invention relates to a sheet sorter which is provided with a plurality of trays and adapted to sort sheets by switching trays for receiving sheets, and also to a copier, a printer or like image forming apparatus provided with such a sheet sorter.

There has been conventionally known a copier for reading a document image and forming a plurality of copy images. Such a copier is provided with a sheet sorter including a plurality of trays on which sheets are placed in order to sort a specified number of sheets having the same image formed thereon for each set. In recent years, the sheet sorter has also been used to sort sheets having images formed thereon for each user or each personal computer or for each personal computer job in a copier commonly used by a plurality of users or in a printer connected with a plurality of personal computers.

The users and the personal computers might designate or not the trays on which the sheets are to be placed. When the tray is designated, the sheet is placed on this tray. On the other hand, when no tray is designated, the sheet is placed on the tray specified beforehand. This specified tray is generally the one on which a maximum number of sheets can be placed. Accordingly, the users know on which trays their sheets are to be placed.

A new sheet having an image formed thereon is discharged onto the sheet already placed on the tray. Thus, even in the case that a plurality of users designate the same tray or designate no tray to place sheets of a plurality of users on the same tray, if each user quickly take the sheet(s) out of the tray after the image formation, there is a low possibility of mixing his sheet(s) with the sheet(s) of the others. Therefore, the sheet(s) of each user can be easily distinguished.

However, the users do not necessarily take the sheets out quickly after the image formation, i.e., they may take time to take the sheets out. If the sheets are taken out after a while, the sheets of many users may be placed one over another. In such a case, each user is likely to experience an incapability of easily finding his own sheet(s) although he knows on which tray his sheets are placed. The tray is often undesignated when the sheets are to be taken out after a while. In such a case, it is more difficult to find the own sheets out since the sheets are placed on the tray on which a maximum number of sheets can be placed.

SUMMARY OF THE INVENTION

It is an object of the present invention to provide a sheet sorter and an image forming apparatus which are free from the problems residing in the prior art.

According to an aspect of the invention, a sheet sorter comprises a plurality of trays for supporting sheets, a tray switching mechanism for switching trays, a designation receiver for receiving designation of a tray on which a specified sheet is to be placed, and a controller for controlling the tray switching mechanism so that a designated tray receives the specified sheet, and controlling the tray switching mechanism so as to switch trays in accordance with a specified order of priority to receive sheets on the trays if no tray is designated. With this construction, users can easily find their own sheets even if no tray is designated.

These and other objects, features, aspects, and advantages of the present invention will become more apparent from the following detailed description of the preferred embodiments/examples with reference to the accompanying drawings.

BRIEF DESCRIPTION OF THE DRAWINGS

FIG. 4 is a diagram showing a display example concerning designation of a tray in the image forming apparatus;

FIG. 5 is a diagram showing a display example concerning an output information of the image forming apparatus.

DETAILED DESCRIPTION OF THE PREFERRED EMBODIMENT OF THE INVENTION

Figure 1:
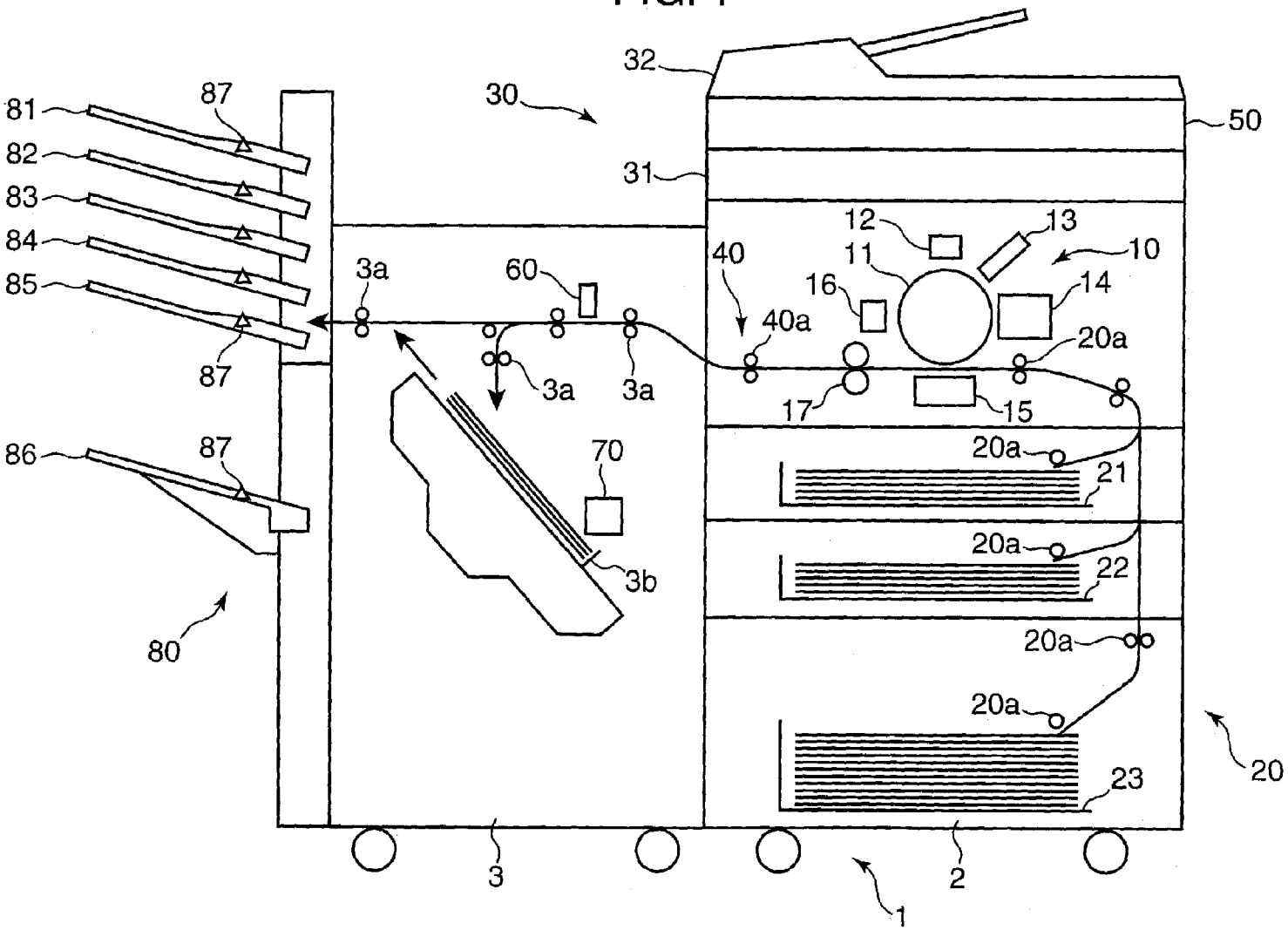
FIG. 1 is a diagram schematically showing an entire construction of an image forming apparatus according to an embodiment of the invention.

Referring to FIG. 1 showing an entire construction of an image forming apparatus according to a preferred embodiment of the invention, an image forming apparatus 1 is comprised of a main unit 2 for forming an image on a sheet and a finisher unit 3 for discharging the sheet having the image formed thereon after applying a specified post-processing thereto. The image forming apparatus 1 functions both as a copier for reading a document image and forming a copy image on a sheet and as a printer for forming an image on a sheet based on information given from a personal computer. Sheets on which images are to be formed are normally paper sheets, but may be non-paper sheets such as resin films according to the usage of a user.

The main unit 2 is provided with a forming assembly 10 directly involved in image formation, a feeding assembly 20 for feeding sheets to the forming assembly 10, a reading assembly 30 for reading a document image, a conveying assembly 40 for conveying the sheet having an image formed thereon to the finisher unit 3, and an operation/display assembly 50 operable by the user and adapted to display pieces of information.

The forming assembly 10 includes a photosensitive drum 11, a charging device 12 for charging the photosensitive drum 11, an exposing device 13 for projecting light onto the charged photosensitive drum 11 to partly remove charges, thereby forming a latent image on the photosensitive drum 11, a developing device 14 for attaching toner to the photosensitive drum 11 bearing the latent image to develop the latent image, a transferring device 15 for transferring a toner image on the photosensitive drum 11 to a sheet being fed, a charge removing device 16 for electrically removing the toner from the photosensitive drum 11 after the image transfer, and a fixing device 17 for pressing the sheet having the toner image transferred thereto while heating it to fix the toner image on the sheet.

The feeding assembly 20 includes a plurality of feeding trays 21, 22, 23 and a plurality of transport rollers 20*a*. Sheets of different sizes are placed in the feeding trays 21 to 23, and the sheets in the selected feeding tray 21 to 23 are fed one by one to the transferring device 15 of the forming assembly 10.

The reading assembly 30 includes a scanner 31 and a automatic document feeder (ADF) 32 for successively feeding documents to the scanner 31, and is used upon the application as a copier. The scanner 31 outputs the read image as a digital image data.

The conveying assembly 40 includes a plurality of transport rollers 40*a*. The finisher unit 3 is detachably attachable to the main unit 2. When the finisher unit 3 is not attached, the sheet conveyed by the conveying assembly 40 is directly discharged from the main unit 2.

The finisher unit 3 is provided with a punch device 60 for perforating the sheets for filing later on, a stapler device 70 for binding a plurality of sheets by staples, a sorter 80 for sorting sheets, transport rollers 3*a*, and an intermediate tray 3*b* in which sheets are placed while being bound by the stapler device 70. The punch device 60 and the stapler device 70 operate only when instruction is given via the operation/display assembly 50.

The sorter 80 includes a plurality of trays 81, 82, 83, 84, 85, 86 for receiving sheets. The trays 81 to 86 are vertically arranged one over another, and are constructed vertically movable by a driving device 801 (see FIG. 2) such as a motor. The driving device 801 sorts sheets by switchingly moving the selected tray 81 to 86 to an end of a sheet conveyance path defined by the transport rollers 3*a*. The bottommost tray 86 is most distanced from the adjacent tray, so that a maximum number of sheets can be placed thereon. For example, in the case that about 300 sheets can be placed on each of the trays 81 to 85, about 3000 sheets can be placed on the tray 86.

Each tray 81 to 86 is provided with a sensor 87 for detecting whether or not any sheet is placed thereon. The sensor 87 includes a light-emitting diode (LED) and a photodiode (PD), is constructed such that light emitted from the LED and reflected by the sheet is received by the PD, and detects the presence or absence of the sheet based on the light reception result. Although the sorter 80 is part of the finisher unit 3 in this embodiment, it may be an individual sheet sorter.

Figure 2:
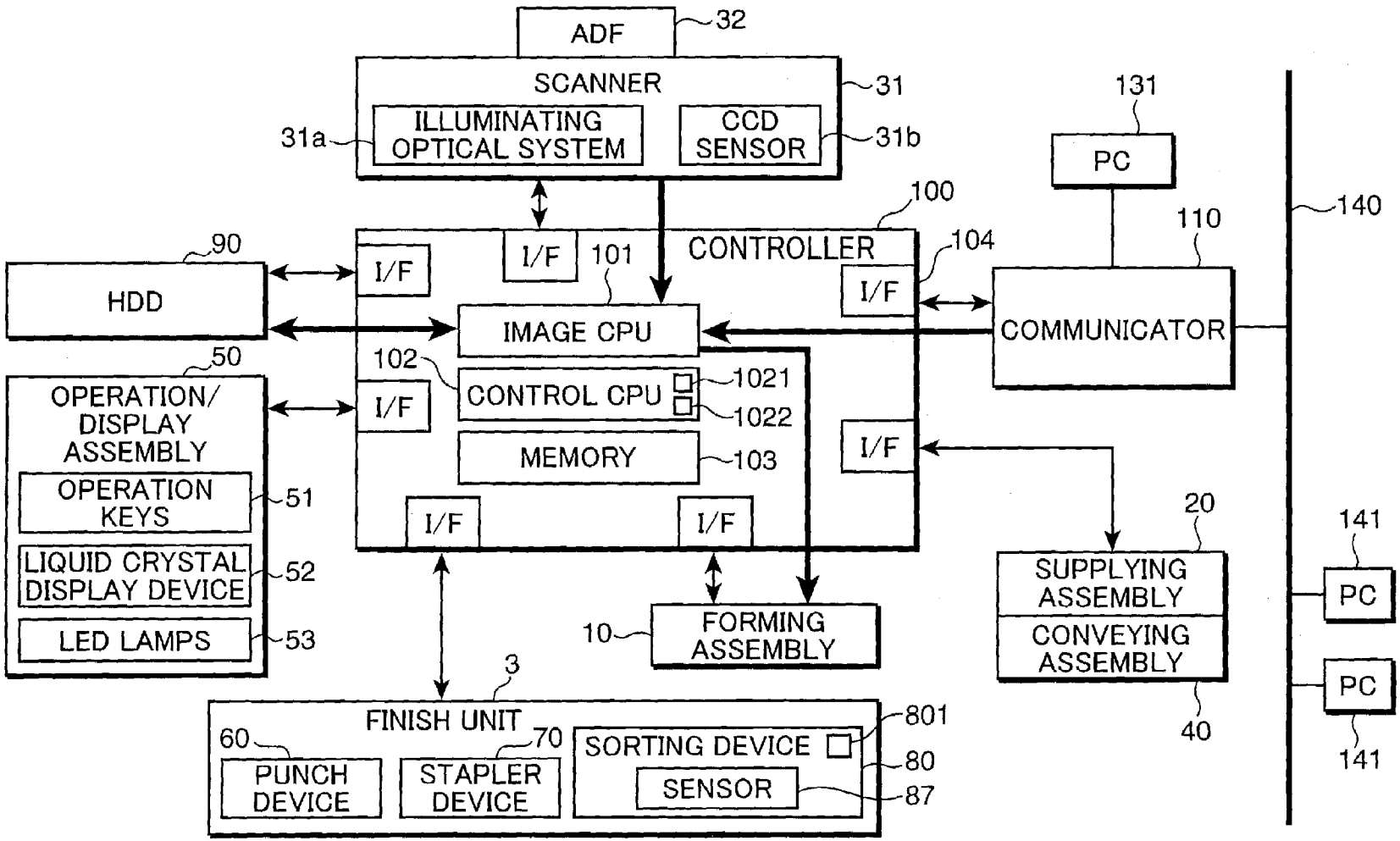
FIG. 2 is a block diagram schematically showing a circuit construction of the image forming apparatus.

FIG. 2 schematically shows a circuit construction of the image forming apparatus 1. Among the respective elements described above, the scanner 31 includes an illuminating optical system 31*a* for illuminating a document image and a CCD line sensor 31*b* for reading the illuminated document image. The operation/display assembly 50 includes a plurality of keys 51 such as a tenkey, a liquid crystal display device 52 and LED lamps 53. The keys 51 are operated by a user to give instructions to the image forming apparatus 1. The liquid crystal display device 52 notifies the user of the states of the image forming apparatus 1 and guides the operation by displaying characters and figures. The LED lamps 53 notify the states of the image forming apparatus 1 by being turned on or off.

The image forming apparatus 1 is provided with a hard disk drive (HDD) 90 including a hard disk for storing image data, a controller 100 for controlling the operation of the entire apparatus including the image formation, and a communicator 110 for conducting a communication with external equipments such as personal computers. A personal computer 131 specially used for the image forming apparatus 1 is connected with the communicator 110, and the user can control the operation of the image forming apparatus 1 without operating the operation/display assembly 50 by giving an instruction to the controller 100 via the personal computer 131. Further, external equipments such as a personal computer 141 and an unillustrated facsimile device can be connected with the communicator 110 via a network 140.

The controller 100 includes an image CPU 101, a control CPU 102, a memory 103 and an interface (I/F) 104. The image CPU 101 controls the image formation. Specifically, the image CPU 101 saves image data given from the scanner 31 and the external personal computer 141 in the hard disk of the HDD 90, reads the image data from the hard disk, applies a suitable processing such as enlargement, size reduction or image combination to the read image data, and controls the image formation by the forming assembly 10 based on the processed image data.

The control CPU 102 controls the entire operation of the image forming apparatus 1 including a part of processings concerning the image formation. For example, the control CPU 102 controls the operations of the charging device 11, the developing device 14, the fixing device 17 and the like of the forming assembly 10, the feed of the sheets by the feeding assembly 20, the image reading by the reading assembly 30, the sheet conveyance by the conveying assembly 40, and the communication with the personal computer 141 by the communicator 110. The control CPU 102 also controls the operations of the punch device 60, the stapler device 70 and the sorter 80 of the finisher unit 3.

In the case that the sorter 80 is an individual sheet sorter, a CPU may be separately provided for the sheet sorter and the control CPU 102 may cause this CPU to execute a control concerning the operation of the sorter 80. In such a case, communications necessary for the control are conducted between the CPU of the sheet sorter and the control CPU 102.

The memory 103 includes a ROM for storing a program specifying procedures of the controls by the image CPU 101 and the control CPU 102 and a RAM for temporarily saving parameters used by the image CPU 101 and the control CPU 102 for the controls. The control CPU 102 is provided with a counter for measuring a time. The present positions of the trays 81 to 86 of the sorter 80 and the times at which the last sheets were placed on the respective trays 81 to 86 are also saved in the RAM.

Figure 3:
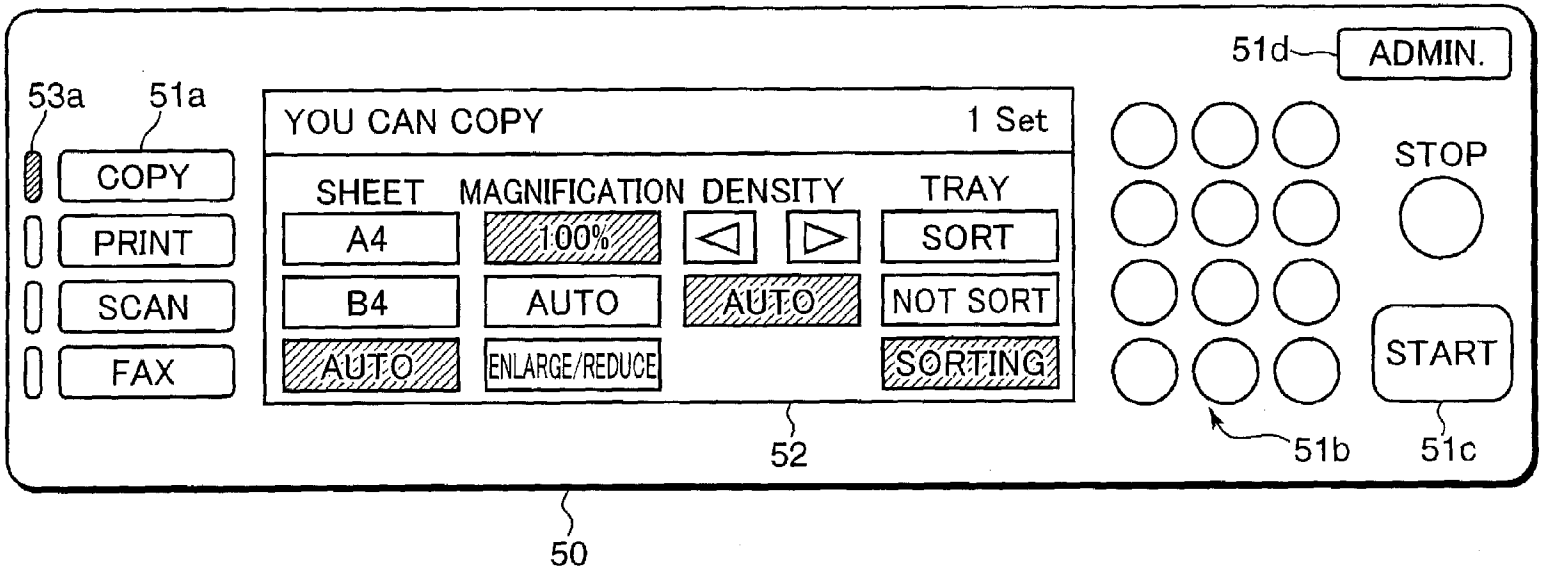
FIG. 3 is a diagram showing an outer configuration of a display/operation assembly of the image forming apparatus.

The image forming apparatus 1 thus constructed has functions as a copier, a printer, a scanner and a facsimile. One exemplary external configuration of the operation/display assembly 50 is shown in FIG. 3. As described above, the operation/display assembly 50 is provided with the keys 51, the liquid crystal display device 52, and the LED lamps 53, and the functions as a copier, a printer, a scanner or a facsimile can be selected by operating the keys 51*a* provided in correspondence with the respective functions. LED lamps 53 are so provided as to correspond to these keys 51*a*, and the one corresponding to the selected function is turned on. The keys 51 include a tenkey 51*b* for the numerical input of 0 to 9, a start key 51*c* used to designate the start of the operation, and an administration key 51*d* used to designate settings and displays concerning the administration of the apparatus.

On the liquid crystal display device 52 are displayed the selected function and items selectable by the user in this selected function. FIG. 3 shows a case where the function as a copier is selected, and such a display is made on the liquid crystal display device 52 to show that the image forming apparatus 1 is in such a state where it can read a document image and form the read image on a sheet, and forms one set of identical images, as well as the items including the size of the sheet on which the images are to be formed, the size or magnification of the images to be formed, the density of the images and necessity to sort the sheets having the images formed thereon. The number of sets of copy images can be designated by operating the tenkey 51*b*. The liquid crystal display device 52 is constructed such that a touch panel for detecting a pushed position is placed on a display surface. The user can designate the item by pressing the position where this item is displayed.

The sorter 80 provided in the finisher unit 3 can be used to sort the sheets when the same image is formed on different sheets. The sorter 80 can also be used to sort the sheets according to the users, according to the personal computers 141, or according to the printing jobs of the personal computers 141. In FIG. 3, sorting according to the users is selected. Unless the user designates the number of sets of images to be formed or select any item, operation is carried out assuming that a specified number of sets of images or one set have been designated and predetermined items have been selected. Unless sorting is designated, the sheet is placed on the tray 86 on which a maximum number of sheets can be placed.

In the state of FIG. 3, the item "SORT" is selected by the user, the display of the liquid crystal display device 52 is switched to display a screen used for the user to designate on which of the trays 81 to 86 the sheet is to be placed. One exemplary screen is shown in FIG. 4. Six items corresponding to the trays 81 to 86 are displayed, whereby the user can select a desired tray. "Main Tray" is the tray 86 on which a maximum number of sheets can be placed. Item "AUTO" meaning that the image forming apparatus 1 automatically selects the tray on which the sheet is to be placed is also displayed. The automatic selection of the tray is a default of sheet sorting, When the user designates no tray, the image forming apparatus 1 selects the tray. Automatic tray selection is described later.

Upon the image formation, the user can input his name and a job name by operating the administration key 51*d* shown in FIG. 3, and the control CPU 102 receives inputted information. Upon receiving an input made by operating the administration key 51*d* after the completion of the image forming operation, the control CPU 102 displays output-related information on the liquid crystal display device 52. Since the user name and the job name are displayed during this display (see FIG. 5), the user can know on which of the trays 81 to 86 of the sorter 80 the sheet having the image formed thereon has been placed by seeing such a display.

FIG. 5 shows a display example of the output-related information. This display includes a job number which is the number of image forming operations made after the start of power supply to the image forming apparatus 1, output date and time, the user name inputted by the user, the job name, the sheet size, the number of sheets, the number of the tray on which the sheets are placed. Here, "Designated Tray" is the tray designated by the user, and "Selected Tray" is the tray automatically selected by the image forming apparatus 1.

Each of the personal computers 131 and the personal computers 141 includes a keyboard provided with a plurality keys used to input instructions, and a monitor having an image display surface. The same contents as those displayed on the liquid crystal display device 52 and shown in FIGS. 3 to 5 are displayed on the display surface of each of the personal computers 131 and the personal computers 141, so that the users of the personal computers 131 and the personal computers 141 can give similar instructions or confirm the tray on which the sheets are placed even without directly operating the operation/display assembly 50. Even if no tray has been designated despite a sorting instruction from the personal computer 131 or 141, the image forming apparatus 1 automatically selects the tray.

The selection of the tray in the case that no tray is designated despite the designation of "SORT" to sort sheets according to the users, the personal computers or jobs is described. The image forming apparatus 1 determines an order of priority as follows based on a mode judging device 1021 and a priority setting device 1022 of the control CPU 102, and selects the tray.

(1) The tray on which no sheet is placed is preferentially selected.

(2) When there are a plurality of trays on which no sheet is placed and the tray located at a sheet receiving position at the judging timing bears no sheet, this tray is selected.

(3) When there are a plurality of trays on which no sheet is placed and the tray located at a sheet receiving position at the judging timing bears a sheet, the uppermost one of the trays bearing no sheet is selected.

(4) When there is no tray on which no sheet is placed, the tray having a longest duration from the last time when the sheet was placed thereon is selected. However, the tray 86 on which a maximum number of sheets can be placed is excluded.

The selections of (2) to (4) are made when the image is formed by the function as a copier (first mode), and the tray is selected in accordance with a different order of priority when the image is formed by the function as a printer or a facsimile (second mode). Specifically, selections are made as follows.

(5) Out of all the trays 81 to 86, the one bearing no sheet and located at a bottommost position is selected.

(6) When there is no tray bearing no sheet, the tray 86 on which a maximum number of sheets can be placed is selected.

The selections of (1) to (6) are made by the mode setting device 1021 of the control CPU 102 for judging the first and second modes and the priority setting device 1022 thereof for selecting the tray in accordance with the order of priority.

Figure 6A:
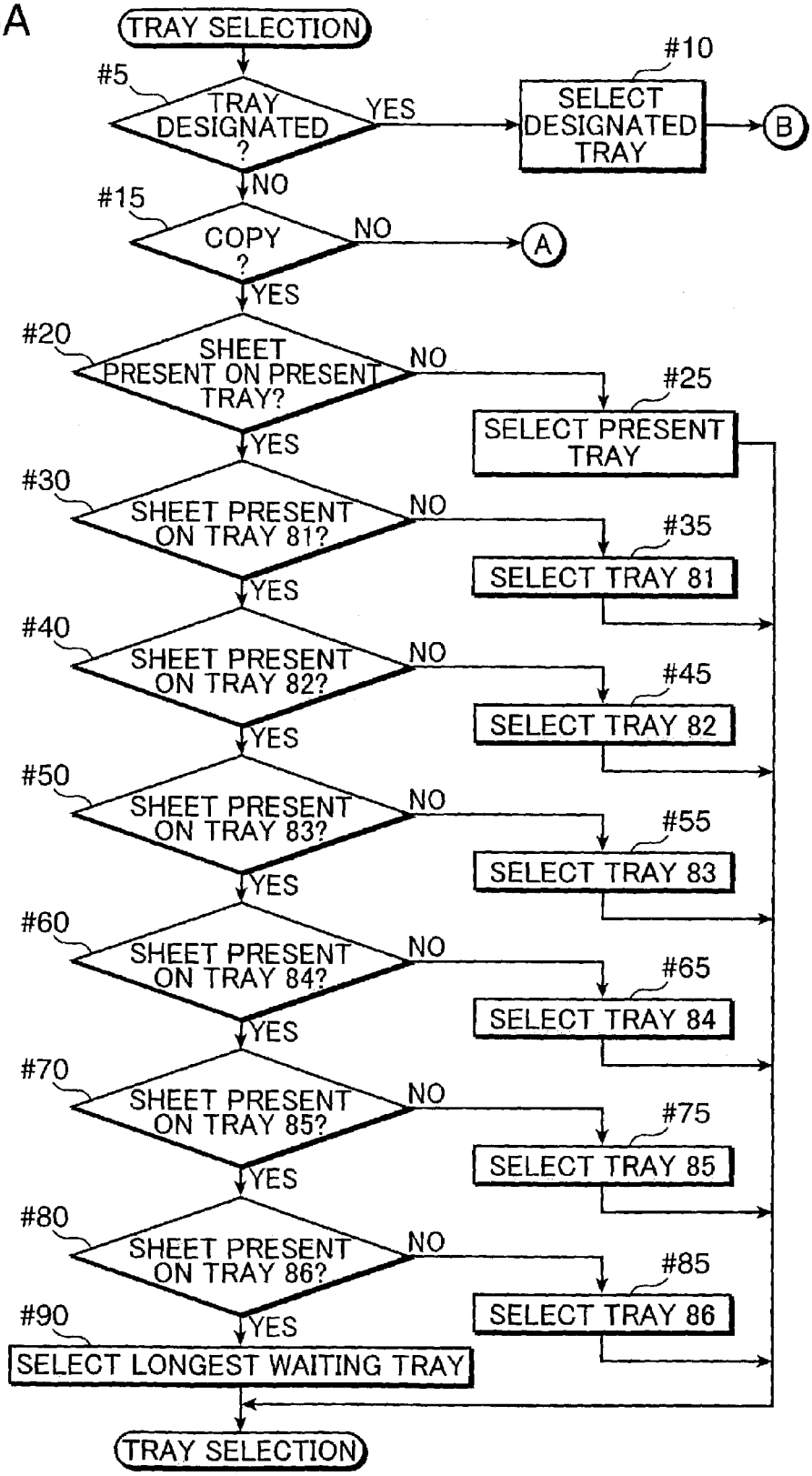
FIGS. 6A and 6B are flowcharts showing a procedure of a tray selecting operation in the image forming apparatus.
Figure 6B:
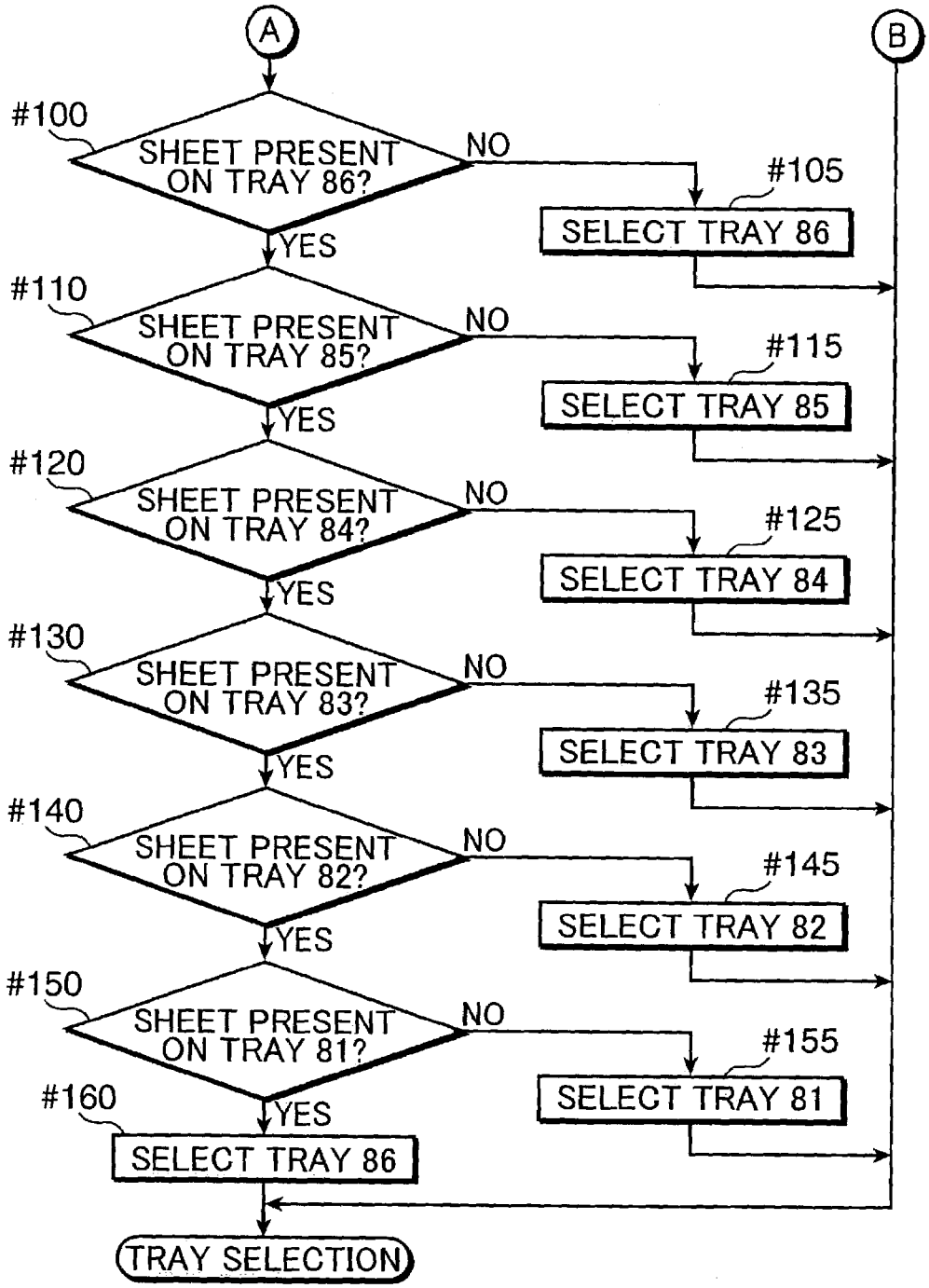

Referring to FIGS. 6A and 6B showing a procedure of the tray selection controlled by the control CPU 102, first, it is discriminated whether the tray has been designated (Step #5). Upon the designation of the tray, this tray is selected as a tray on which the sheet is to be placed (Step #10). If no tray has been designated, it is discriminated whether the first mode in which an image is formed by the function as a copier is set (Step #15).

When the image is to be formed by the function as a copier, it is discriminated whether there is any sheet on the tray located at the sheet receiving position (Step #20). If no sheet is placed thereon, this tray is selected (Step0 #25). The presence or absence of the sheet on the tray is detected by the sensor 87 as described above. If the sheet is placed on the tray located at the sheet receiving position, discrimination as to whether the sheet is placed is successively made for the respective trays from the uppermost one 81. Upon finding the tray bearing no sheet, this tray is selected (Step #30 to #85).

When all the trays 81 to 86 bear the sheets, the tray having a longest duration from the last time when the sheet was placed thereon is selected out of the trays 81 to 85 excluding the tray 86 (Step #90). The times at which the sheets were placed are saved in the memory 103, and the above selection is made by calculating differences between the respective recorded times and the current time.

If the image is discriminated not to be formed by the function as a copier in Step #15, i.e., if the second mode in which an image is formed on a sheet based on information given from an external equipment via a communication therewith is set, discrimination as to whether the sheet is placed is successively made for the respective trays from the bottommost one 86. Upon finding the tray bearing no sheet, this tray is selected (Step #100 to #155). If the sheet is placed on any of the trays 81 to 86, the tray 86 is selected (Step #160).

In the above selecting operation, the sheet is placed on the tray bearing no sheet as long as there is any tray bearing no sheet, and the respective users need not distinguish their sheets from the other users' sheets. Further, when the image forming apparatus 1 is used as a copier, if there are a plurality of trays bearing no sheet, the uppermost one thereof is selected. Thus, the sheets can be easily taken out. Furthermore, when the sheet is placed on any of the trays, the sheet is to be placed on the tray having a longest duration from the last time when the sheet was placed, hence, having a lower possibility of having the sheet thereon taken out for a while. Thus, the sheet placed on this tray can be taken out before the other users take the sheets out. Therefore, the image forming apparatus 1 can also attend to the convenience of the other users.

The selection of the tray having a longest duration from the last time when the sheet was placed is useful for a construction in which the sensors 87 are not provided. The longer the duration from the last time when the sheet was placed, the higher possibility of having the sheets taken out. Therefore, a possibility of selecting the tray bearing no sheet is increased.

By differing the order of priority of the trays depending on whether the image forming apparatus 1 functions as a copier or it functions as a printer or a facsimile, the sheet having the image formed thereon by the function as a copier and the one having the image formed thereof by the function as a printer or a facsimile are more likely to be placed on different trays. Thus, the user using the function as a copier can easily find his sheet.

Setting of the order of priority in the tray selection shown in this embodiment is only an example. Another order of priority can be set depending on the number of the trays, the size of trays, the numbers of sheets which can be placed on the respective trays, the number of sheets to have images formed thereon at once and other factors. For example, if the number of sheets is a specified value or larger, the tray on which a maximum number of sheets can be placed may be preferentially selected instead of selection based on the above order of priority.

Although the trays are, for example, vertically moved by the driving device 801 in the foregoing embodiment, the end of the sheet conveyance path may be so branched as to correspond to the trays and such a driving as to selectively switch the branched paths to place the sheet on the designated or automatically selected tray may be provided instead. This construction also enables the sheet to be placed on the selected tray.

As described above, an inventive sheet sorter is provided with a plurality of trays on which sheets are to be placed; a tray switching mechanism which switches trays; a designation receiver which receives designation of a tray on which a sheet is to be placed; and a controller which controls the tray switching mechanism so that a designated tray receives the specified sheet, and controls the tray switching mechanism so as to switch trays in accordance with a specified order of priority to receive sheets on the trays if no tray is designated.

With this sheet sorter, when no tray is designated, the sheet is to be placed not on the specific tray, but on the tray selected from all or a part of the plurality of trays in accordance with the specified order of priority. This can reduce the possibility of placing sheets of a plurality of users on the same tray. Therefore, the respective users can more easily find their own sheets.

Preferably, higher priority is given to a tray on which no sheet is placed than to those on which a sheet is placed. Then, sheets are to be placed first on empty trays, thereby considerably reducing the possibility of placing sheets of different users on the same tray.

In such a case, the trays may be vertically arranged one over another, and higher priority may be given to the tray located at a higher position. In the case that the trays are arranged one over another, sheets can be successively placed on trays from which sheets are more easily taken out by giving higher priority to a tray located at a higher position. Thus, the sheet sorter takes up a smaller space and sheets can be successively placed on trays from which sheets are more easily taken out.

Alternatively, higher priority may be given to a tray having a longer duration from the last time when a sheet was placed thereon. The longer the duration after the sheet is placed last time, the higher the possibility that the sheet is already taken out. Thus, by setting the order of priority in this way, the tray bearing no sheet can be selected with a higher possibility even if no means for detecting whether or not the sheet is placed on the tray is provided.

Preferably, least priority may be given to a tray capable of supporting a maximum number of sheets. By giving the least priority to the tray on which sheets of many users are likely to be placed, the respective users can easily find their own sheets while enabling handling of many sheets.

Also, an inventive image forming apparatus is made by providing the sheet sorter in an image forming unit for forming an image on a sheet. Then, users can easily find their own sheets after the image formation by the features of the sheet sorter.

The image forming unit may have a first mode in which an image is read from a document and the read image is formed on a sheet, and a second mode in which the image forming unit communicates with an external equipment and an image is formed on the sheet based on information given from the external equipment, and the order of priority in selecting the tray may be differed depending on whether the first mode is set or the second mode is set. This image forming unit functions as a copier in the first mode while functioning as a printer or a facsimile in the second mode. Users using the function as a copier are near the apparatus and often need the sheets after the image formation immediately. By differing the order of priority in selecting the tray depending on whether the first mode is set or the second mode is set, the users using the function as a copier can easily find their own sheets.

This application is based on patent application No. 2002-147525 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet sorter, comprising:

a plurality of trays on which sheets are to be placed;

a tray switching mechanism which switches the trays;

a designation receiver which receives designation of a tray on which a specified sheet is to be placed; and a controller which controls the tray switching mechanism so that a designated tray receives the specified sheet, and controls the tray switching mechanism so as to switch the trays in accordance with a specified order of priority to receive sheets on the trays if no tray is designated, wherein the controller gives higher priority to a tray having a longer duration from the last time when a sheet was placed thereon.

2. An image forming apparatus comprising:

a sheet sorter including:

a plurality of trays, on which sheets are to be placed, vertically arranged one over another;

a tray switching mechanism which switches the trays;

a designation receiver which receives designation of a tray on which a specified sheet is to be placed;

a controller which controls the tray switching mechanism so that a designated tray receives the specified sheet, and controls the tray switching mechanism so as to switch the trays in accordance with a specified order of priority to receive sheets on the trays if no tray is designated; and said specified order of priority includes priority being given to trays on which no sheet is placed and priority being given to higher position trays of the trays on which no sheet is placed; and an image forming unit which performs forming of an image on the sheet received on the trays;

the image forming unit having:

a first mode in which an image is read from a document and the read image is formed on a sheet, and a second mode in which the image forming unit communicates wit an external equipment and an image is formed on a sheet based on information given from the external equipment; and the controller differs the order of priority in selecting a tray depending on whether the first mode is set or the second mode is set.

3. The image forming apparatus according to claim 2, wherein during the first mode the controller gives higher priority to a tray having a longer duration from the last time when a sheet was placed thereon if there are no trays on which no sheet is placed.

4. The image funning apparatus according to claim 3, wherein a tray capable of supporting a maximum number of sheets is excluded from priority consideration of the tray having a longer duration from the last time when a sheet was placed thereon.

5. The image forming apparatus according to claim 2, wherein, during the second mode, a tray capable of supporting a maximum number of sheets is designated if there are no trays on which no sheet is placed.

6. An image forming apparatus comprising:

a sheet sorter including:

a plurality of trays on which sheets are to be placed;

a tray switching mechanism which switches the trays;

a designation receiver which receives designation of a tray on which a specified sheet is to be placed; and a controller which controls the tray switching mechanism so that a designated tray receives the specified sheet, and controls the tray switching mechanism so as to switch the trays in accordance with a specified order of priority to receive sheets on the trays if no tray is designated, wherein the controller gives higher priority to a tray having a longer duration from the last time when a sheet was placed thereon, and an image forming unit which performs fanning of an image on the sheet received on the trays.

7. The image forming apparatus according to claim 6 wherein: the image forming unit has;

a first mode in which an image is read from a document and the read image is formed on a sheet, and a second mode in which the image forming unit communicates with an external equipment and an image is formed on a sheet based on information given from the external equipment; and the controller differs the order of priority in selecting a tray depending on whether the first mode is set or the second mode is set.

8. The image forming apparatus according to claim 7, wherein during the first mode the controller gives higher priority to a tray having a longer duration from the last time when a sheet was placed thereon if there are no trays on which no sheet is placed.

9. The image forming apparatus according to claim 8, wherein a tray capable of supporting a maximum number of sheets is excluded from priority consideration of the tray having a longer duration from the last time when a sheet was placed thereon.

10. The image forming apparatus according to claim 7, wherein, during the second mode a tray capable of supporting a maximum number of sheets is designated if there are no trays on which no sheet is placed.

11. An image forming apparatus comprising:

a sheet sorter including:

a plurality of trays on which sheets arc to be placed;

a tray switching mechanism which switches the trays;

a designation receiver which receives designation of a tray on which a specified sheet is to be placed; and a controller which controls the tray switching mechanism so that a designated tray receives the specified sheet, and controls the tray switching mechanism so as to switch the trays in accordance with a specified order of priority to receive sheets on the trays if no tray is designated, wherein the controller gives least priority to a tray capable of supporting a maximum number of sheets, and an image forming unit which performs forming of an image on the sheet received on the trays;

the image forming unit having:

a first mode in which an image is read from a document and the read image is formed on a sheet, and a second mode in which the image forming unit communicates with an external equipment and an image is formed on a sheet based on information given from the external equipment; and the controller differs the order of priority in selecting a tray depending on whether the first mode is set or the second mode is set.

12. The image forming apparatus according to claim 11, wherein during the first mode the controller gives higher priority to a tray having a longer duration from the last time when a sheet was placed thereon if there are no trays on which no sheet is placed.

13. The image forming apparatus according to claim 12, wherein a tray capable of supporting a maximum number of sheets is excluded from priority consideration of the tray having a longer duration from the last time when a sheet was placed thereon.

14. The image forming apparatus according to claim 11, wherein, during the second mode a tray capable of supporting a maximum number of sheets is designated if there are no trays on which no sheet is placed.

* * * * *